US008909113B2

(12) United States Patent
Kawajiri

(10) Patent No.: US 8,909,113 B2
(45) Date of Patent: Dec. 9, 2014

(54) PRINTING APPARATUS THAT CLEANS FIXING DEVICE, METHOD OF CONTROLLING THE PRINTING APPARATUS, AND STORAGE MEDIUM

(75) Inventor: Kensuke Kawajiri, Yokohama (JP)

(73) Assignee: Canon Kabushiki Kaisha (JP)

( * ) Notice: Subject to any disclaimer, the term of this patent is extended or adjusted under 35 U.S.C. 154(b) by 182 days.

(21) Appl. No.: 13/472,667

(22) Filed: May 16, 2012

(65) Prior Publication Data

US 2012/0294642 A1 Nov. 22, 2012

(30) Foreign Application Priority Data

May 17, 2011 (JP) ..... 2011-110281

(51) Int. Cl.
*G03G 15/20* (2006.01)

(52) U.S. Cl.
CPC .. *G03G 15/2025* (2013.01); *G03G 2215/00531* (2013.01)
USPC ..... 399/327

(58) Field of Classification Search
CPC ..... G03G 15/2025; G03G 15/2075
USPC ..... 399/327
See application file for complete search history.

(56) References Cited

U.S. PATENT DOCUMENTS

| | | | | |
|---|---|---|---|---|
| 5,865,121 | A * | 2/1999 | Testardi et al. | 101/483 |
| 6,026,272 | A * | 2/2000 | Kusaka et al. | 399/327 |
| 2002/0154926 | A1 * | 10/2002 | Katoh | 399/327 |
| 2008/0199197 | A1 * | 8/2008 | Suzuki et al. | 399/67 |

FOREIGN PATENT DOCUMENTS

| | | | |
|---|---|---|---|
| JP | 08-328421 | A | 12/1996 |
| JP | 10-240047 | A | 9/1998 |
| JP | 2001-022216 | A | 1/2001 |

OTHER PUBLICATIONS

Machine translation of JP 08-328421, publication date: Dec. 13, 1996.*

Korean Office Action cited in Korean counterpart application No. KR10-2012-0049331, dated May 30, 2014.

* cited by examiner

*Primary Examiner* — Walter L Lindsay, Jr.
*Assistant Examiner* — Frederick Wenderoth
(74) *Attorney, Agent, or Firm* — Rossi, Kimms & McDowell LLP

(57) ABSTRACT

A printing apparatus provided with a mechanism capable of selecting an appropriate one of a plurality of applicable cleaning methods so as to clean a pressure roller of a fixing device. The printing apparatus conveys a sheet from a sheet feeder and performs cleaning of the fixing device using the conveyed sheet, by a first cleaning method or a second cleaning method more effective than the first cleaning method. When the number of printed sheets is smaller than a first threshold value, a first cleaning process is performed on the fixing device by the first cleaning method, whereas when the number of sheets printed is not smaller than the first threshold value, a second cleaning process is performed on the fixing device by the second cleaning method.

12 Claims, 10 Drawing Sheets

PRINTING APPARATUS THAT CLEANS FIXING DEVICE, METHOD OF CONTROLLING THE PRINTING APPARATUS, AND STORAGE MEDIUM

BACKGROUND OF THE INVENTION

1. Field of the Invention

The present invention relates to a printing apparatus and a method of controlling the same, as well as to a storage medium, and more particularly to a printing apparatus that cleans a pressure roller within a fixing device and a method of controlling the printing apparatus, as well as to a storage medium.

2. Description of the Related Art

In a conventional printing apparatus, a toner image transferred onto a sheet is fixed onto the sheet by a fixing device comprising a heating roller and a pressure roller. Some of the printing apparatuses of this type perform cleaning of the fixing device in response to a user instruction. For example, a cleaning method described below has been disclosed in Japanese Patent Publication No. 2001-22216. In the cleaning method, upon receipt of a cleaning instruction from a user, a printing apparatus feeds only one sheet from a sheet feed cassette and forms an image for cleaning, using C (cyan), M (magenta), Y (yellow), and K (black) toners, and fixes the toner image onto the sheet. Then, the sheet is set in the sheet feed cassette such that the sheet will pass through the fixing device with a surface thereof having the toner image formed thereon facing the pressure roller, and then is fed to pass through the fixing device, to thereby cause the sheet to wipe off toner sticking to the pressure roller from the pressure roller.

Besides the above-described method of cleaning toner stains off the pressure roller by using C, M, Y, and K toners, there has been proposed a method of cleaning toner stains off the pressure roller by using K toner (see e.g. Japanese Patent Laid-Open Publication No. 2001-22216). The method using K toner is advantageous in saving user's time and labor, though the method is inferior in cleaning effect to the method using C, M, Y, and K toners.

Further, there has been proposed a cleaning method in which when the remaining amount of toner becomes equal to or smaller than a predetermined amount, a recording sheet is conveyed so as to remove toner from the pressure roller of the fixing device (see e.g. Japanese Patent Laid-Open Publication No. H08-328421).

In a printing apparatus capable of executing the above-mentioned cleaning methods, cleaning effects provided by the respective cleaning methods are different, and the consumption of consumables and complexity in user operation are also different. For this reason, it is difficult for a user to determine which cleaning method is to be executed in what situations.

SUMMARY OF THE INVENTION

The present invention provides a printing apparatus that is capable of selecting an appropriate cleaning method from a plurality of applicable cleaning methods before executing cleaning of a pressure roller of a fixing device.

In a first aspect of the present invention, there is provided a printing apparatus including a fixing device for fixing an image formed on a sheet conveyed from a sheet holding section, comprising a cleaning unit configured to convey a sheet from the sheet holding section and perform cleaning of the fixing device using the conveyed sheet, by a first cleaning method or a second cleaning method more effective than the first cleaning method, and a control unit configured to perform control, when a number of printed sheets is smaller than a first threshold value, such that a first cleaning process is performed on the fixing device by the first cleaning method, and when the number of printed sheets is not smaller than the first threshold value, such that a second cleaning process is performed on the fixing device by the second cleaning method.

In a second aspect of the present invention, there is provided a method of controlling a printing apparatus including a fixing device for fixing an image formed on a sheet conveyed from a sheet holding section, comprising conveying a sheet from the sheet holding section and performing cleaning of the fixing device using the conveyed sheet, by a first cleaning method or a second cleaning method more effective than the first cleaning method, and performing control, when a number of printed sheets is smaller than a first threshold value, such that a first cleaning process is performed on the fixing device by the first cleaning method, and when the number of printed sheets is not smaller than the first threshold value, such that a second cleaning process is performed on the fixing device by the second cleaning method.

In a third aspect of the present invention, there is provided a non-transitory computer-readable storage medium storing a computer-executable program for causing a computer to execute a method of controlling a printing apparatus including a fixing device for fixing an image formed on a sheet conveyed from a sheet holding section, wherein the method comprises conveying a sheet from the sheet holding section and performing cleaning of the fixing device using the conveyed sheet, by a first cleaning method or a second cleaning method more effective than the first cleaning method, and performing control, when a number of printed sheets is smaller than a first threshold value, such that a first cleaning process is performed on the fixing device by the first cleaning method, and when the number of printed sheets is not smaller than the first threshold value, such that a second cleaning process is performed on the fixing device by the second cleaning method.

The present invention enables the printing apparatus to select an appropriate cleaning method from applicable cleaning methods before executing cleaning of the pressure roller of the fixing device, without requiring user's determination of which cleaning method is to be executed.

Further features of the present invention will become apparent from the following description of exemplary embodiments with reference to the attached drawings.

DESCRIPTION OF THE EMBODIMENTS

The present invention will now be described in detail below with reference to the accompanying drawings showing an embodiment thereof.

Figure 1:
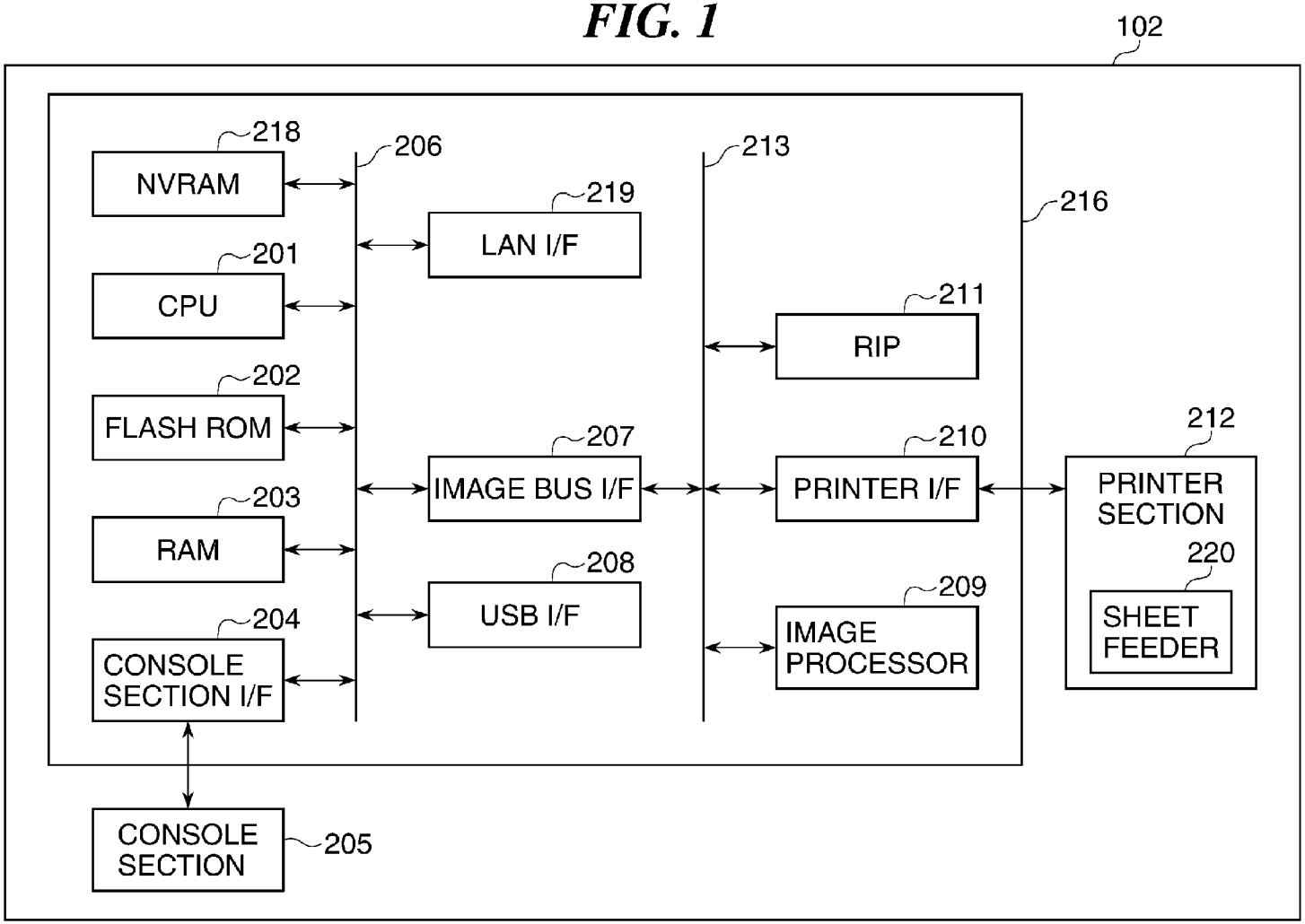
FIG. 1 is a schematic block diagram of a printing apparatus according to an embodiment of the present invention.

FIG. 1 is a schematic block diagram of a printing apparatus according to the embodiment of the present invention.

The printing apparatus 102 is e.g. a printer, and comprises a printer section 212, a sheet feeder 220, a console section 205, and a controller unit 216.

The printer section 212 has a mechanism for converting raster image data to an image on a sheet. The printer section 212 employs the electrophotographic method using photosensitive drums and a photosensitive belt, as a printing method, but the printing method may be the inkjet method in which an image is directly printed on a sheet by jetting ink onto a sheet from an array of very small nozzles, or any other appropriate printing method. The printing operation of the printer section 212 is started in response to a command from a CPU 201 of the controller unit 216.

The console section 205 has an LCD display section, not shown, and operation keys, not shown, and is connected to a console section interface 204 of the controller unit 216. The sheet feeder 220 contains sheets, and the sheets are fed from the sheet feeder 220 to the printer section 212. The sheet feeder 220 can be, for example, a sheet feed cassette, a manual tray, or a sheet feed deck. The sheet feeder 220 is not limited to these examples, but it may be by any other unit that functions as a sheet holding section capable of feeding sheets held therein.

The controller unit 216 inputs and outputs image data and device information to and from the printer section 212.

Next, a description will be given of devices constituting the controller unit 216.

The CPU 201 serves as a processor for controlling the whole system. A RAM 203 serves as a system work memory used by the CPU 201 for operation thereof, and also serves as a program memory for storing programs and an image memory for temporarily storing image data. An NVRAM (non-volatile RAM) 218 is a nonvolatile memory for storing information on settings and the like of the printing apparatus 102. A flash ROM 202 is a data-rewritable nonvolatile memory which stores various kinds of control programs for controlling the system.

Figure 5A:
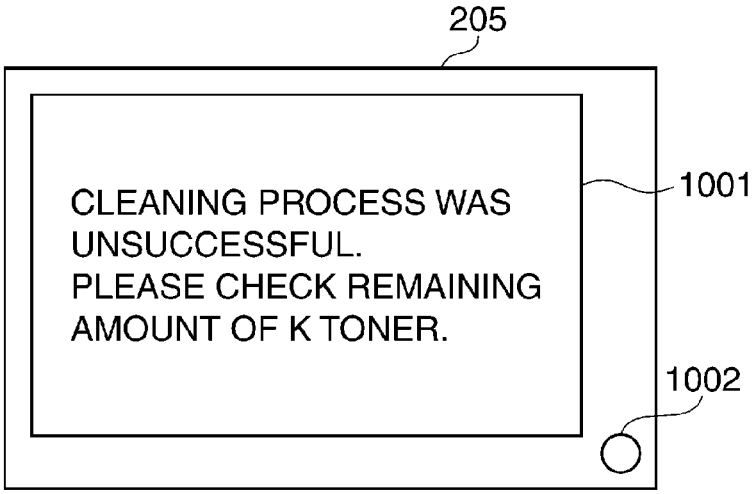
FIG. 5A is a view of an example of display contents displayed on a console section in a step in FIG. 3A.
Figure 5B:
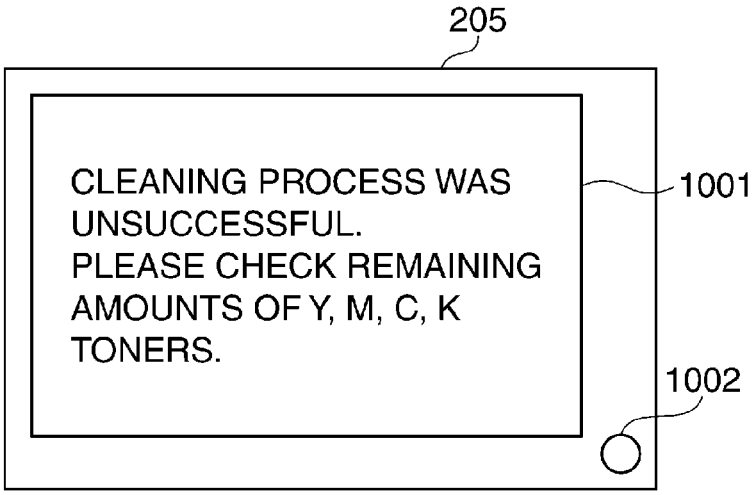
FIG. 5B is a view of an example of display contents displayed on the console section in another step in FIG. 3B.
Figure 5C:
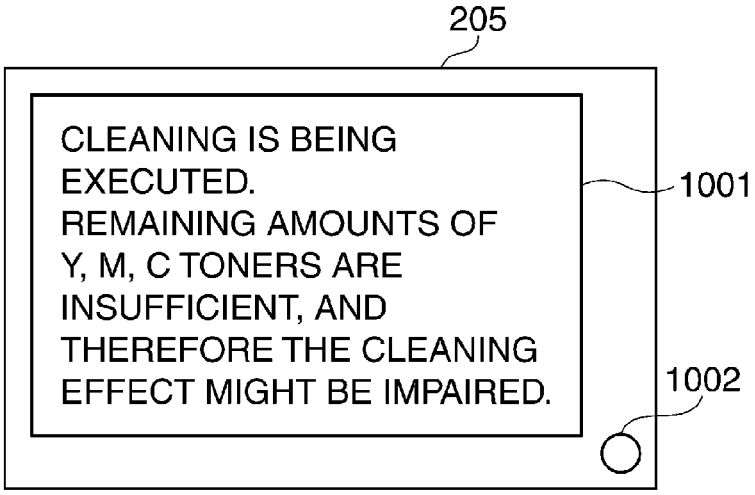
FIG. 5C is a view of an example of display contents displayed on the console section in another step in FIG. 3B.

The console section interface 204 is connected to the console section 205 to output image data to be displayed on the console section 205. Further, the console section interface 204 transfers information input by a user via the console section 205 to the CPU 201. The user can use the console section 205 to configure print settings and issues a print instruction to the printing apparatus 102. As shown in FIGS. 5A to 5C, the console section 205 is provided with an LCD display section 1001 and an operation key 1002.

A USB interface 208 provides interface for USB (universal serial bus) connection to an external device. The USB interface 208 is used so as to acquire the status of an external device or send the status of the printing apparatus 102 to the external device via a USB cable, or to receive a print job.

A LAN interface 219 provides interface for connecting the printing apparatus 102 to a LAN (local area network). The LAN interface 219 is used so as to acquire the status of an external device or send the status of the printing apparatus 102 to the external device via a LAN cable, or to receive a print job.

The above-described devices are arranged on a system bus 206.

An image bus interface 207 is a bus bridge that connects between the system bus 206 and an image bus 213 that transfers image data at high speed and carries out conversion of data structures. The image bus 213 is implemented by a PCI bus or an IEEE 1394 bus. On the image bus 213 are arranged the following devices:

A RIP (raster image processor) 211 converts vector data, such as a PDL (page description language) code, to a bitmap image. A printer interface 210 provides interface for connecting between the printer section 212 and the controller unit 216 for data communication.

An image processor 209 corrects, manipulates, and edits input image data, and performs correction, resolution conversion, etc. of image data to be output. Further, the image processor 209 rotates image data, or converts multi-valued image data to JPEG data. Furthermore, the image processor 209 compresses or expands binary image data by JBIG, MMR or MH.

Figure 2:
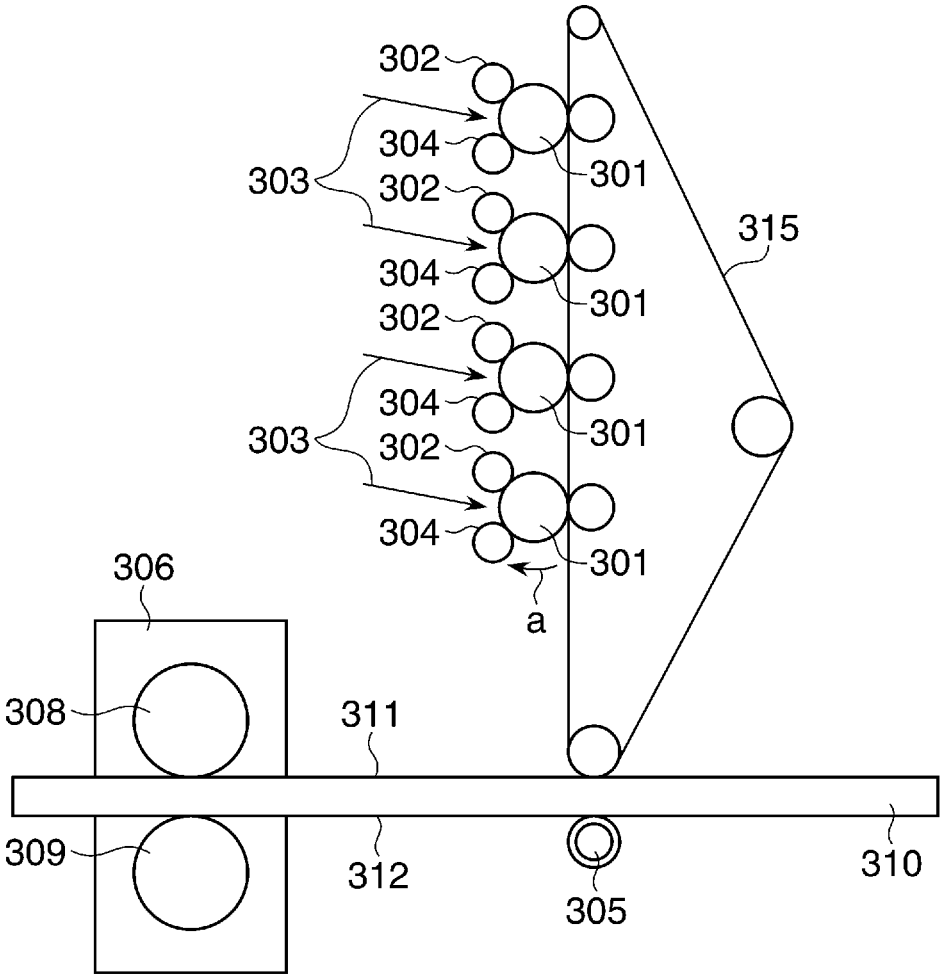
FIG. 2 is a schematic partial cross-sectional view of a printer section appearing in FIG. 1.

FIG. 2 is a schematic partial cross-sectional view of the printer section 212 appearing in FIG. 1.

Referring to FIG. 2, the printer section 212 includes photosensitive drums 301 of four colors, and each photosensitive drum 301 is a photosensitive member formed by covering a cylindrical substrate e.g. of aluminum or nickel with a photosensitive material e.g. of OPC (organic photo conductor), amorphous Se, or amorphous Si. The photosensitive drum 301 is rotated in a direction indicated by an arrow "a" in FIG. 2. Note that the photosensitive drums 301 appearing in FIG. 2 correspond to the four colors of K (black), C (cyan), M (magenta), and Y (yellow) in the order from the top, respectively.

First, each of the photosensitive drum 301 has its surface uniformly charged by an associated one of electrostatic charging rollers 302. Next, the photosensitive drum 301 is scanned with a laser beam 303 which is on/off controlled according to image data, whereby an electrostatic latent image is formed on the surface of the photosensitive drum 301.

Each developing device 304 develops the electrostatic latent image on an associated one of the photosensitive drums 301 into a toner image by attaching toner onto the electrostatic latent image. As a development method, there may be mentioned the jumping development method, the two-component development method, the FEED (floating electrode effect development) method, and so forth. Further, a combination of image exposure and inversion development, for example, is often used.

Y, M, C, and K toner images formed on the respective associated photosensitive drums 301 are transferred onto an intermediate transfer belt 315 in the mentioned order. A sheet 310 is conveyed in between a transfer roller 305 and the intermediate transfer belt 315 in predetermined timing, and the toner image is transferred onto a first side 311 of the sheet 310 from the intermediate transfer belt 315. At this time, the sheet 310 is conveyed in between the intermediate transfer belt 315 and the transfer roller 305 while being nipped with a predetermined pressure force. Note that no toner image is transferred onto a second side 312 of the sheet 310.

The sheet 310 having the toner image transferred on the first side 311 is conveyed to a fixing device 306. Note that residual toner on each of the photosensitive drums 301 after transfer of the respective toner images is removed by an associated cleaning device, not shown.

The fixing device 306 comprises a fixing roller 308 driven by a motor, not shown, and a pressure roller 309 rotatable along with the rotation of the fixing roller 308. The fixing roller 308 has a heater, such as a halogen heater, provided therein so as to heat an unfixed toner image transferred on a sheet and fix the same onto the sheet. That is, the fixing roller 308 functions as a heating roller. The pressure roller 309 is pressed against the fixing roller 308 with a predetermined pressing force by a pressurizing mechanism, not shown.

The fixing device 306 causes pressure contact parts, formed by bringing the fixing roller 308 and the pressure roller 309 as a rotary member pair into pressure contact with each other, to nip and convey the sheet 310 having the unfixed toner image transferred thereon, to thereby thermally fix the toner image on the sheet 310 by heat and pressure.

Next, a description will be given of control of a plurality of cleaning processes for cleaning the pressure roller 309 in the fixing device 306, which are executed in the printing apparatus 102.

Figure 3A:
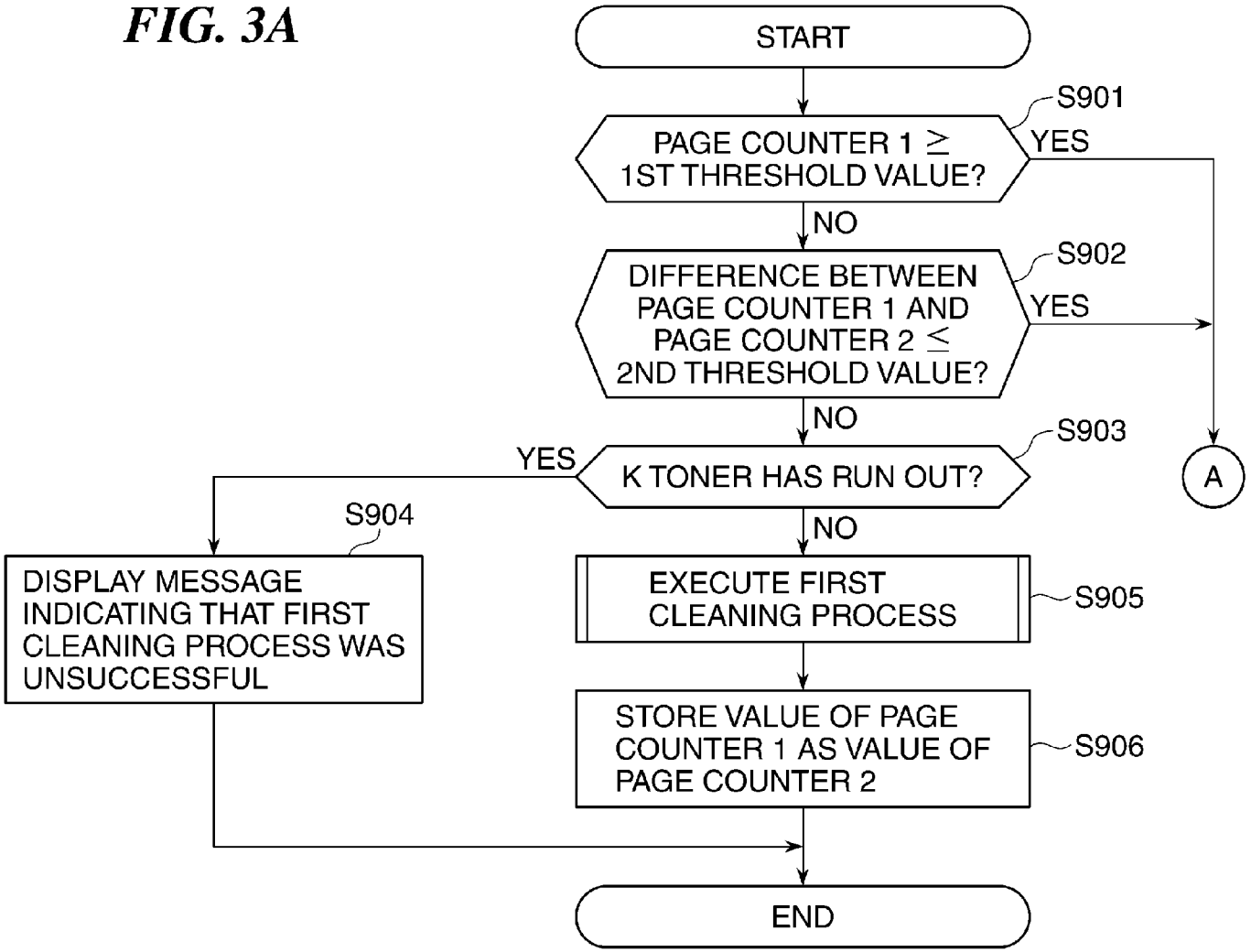
FIG. 3A is a flowchart of a cleaning control process which is executed by the printing apparatus so as to clean toner stains from a pressure roller.
Figure 3B:
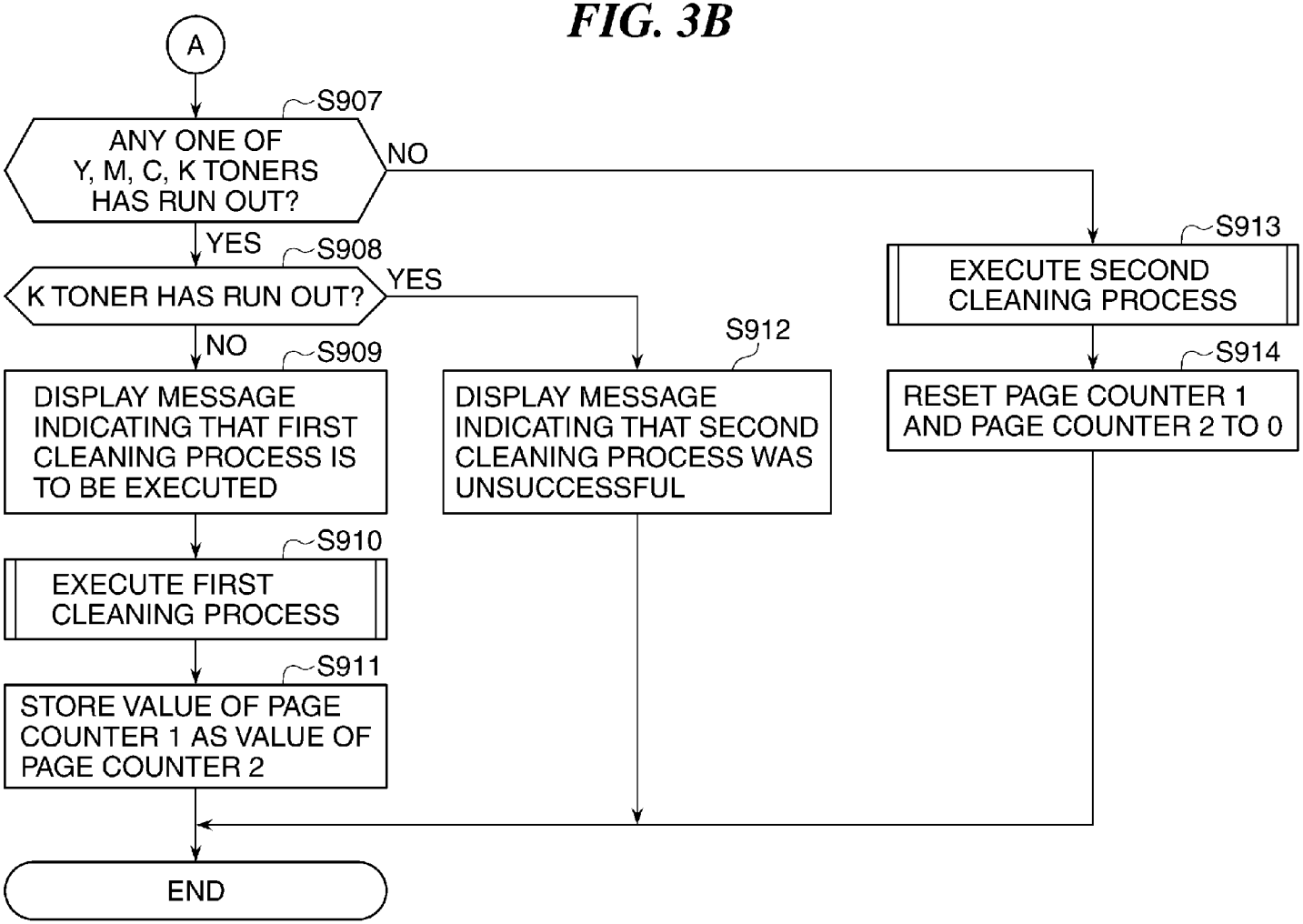
FIG. 3B is a continuation of FIG. 3A.

FIGS. 3A and 3B are a flowchart of a cleaning control process for removing toner stains from the pressure roller 309, which is executed by the printing apparatus 102. Steps of the cleaning control process shown in the flowchart in FIGS. 3A and 3B are carried out by the CPU 201 executing an associated program therefor stored in the flash ROM 202.

When a cleaning execution instruction is received from the user via the console section 205, the present cleaning control process is started. The cleaning control process includes a process executed by the CPU 201 of the controller unit 216 for selecting between a first cleaning process in FIG. 6 and a second cleaning process shown in FIG. 7.

Figure 4:
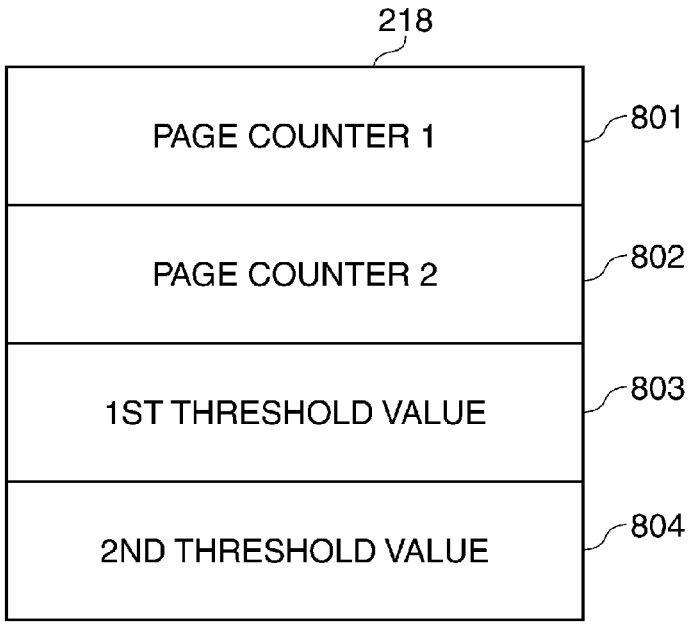
FIG. 4 is a diagram schematically illustrating page counter values and threshold values stored in an NVRAM.

Referring to FIG. 3A, first, upon receipt of the cleaning execution instruction from a user via the console section 205, the CPU 201 makes a comparison between a value of a page counter 1 and a first threshold value both appearing in FIG. 4 to thereby determine whether or not the value of the page counter 1 is equal to or larger than the first threshold value (step S901). The page counter 1 is a variable which is incremented by 1 whenever the printing apparatus 102 prints one page, and the value of the page counter 1 is stored in the NVRAM 218. When the second cleaning process, described hereinafter, is executed, the value of the page counter 1 is reset to 0. Now, the values of page counters and associated threshold values stored in the NVRAM 218 will be described with reference to FIG. 4.

In FIG. 4, the NVRAM 218 has an area 801 storing the value of the page counter 1, an area 802 storing the value of a page counter 2, an area 803 storing the first threshold value, and an area 804 storing a second threshold value. The value of the page counter 1 indicates the number of pages which have been subjected to printing or fixing after the immediately preceding execution of the second cleaning process. Note that the page counter 1 is factory-set to 0, and the number of printed pages is stored only after the use of the printing apparatus is started. The page counter 2 indicates timing in which the first cleaning process was executed last.

The first threshold value and the second threshold value are constants for adjusting execution timing for the respective first and second cleaning processes. The first and second threshold values are set in advance e.g. by an administrator or a manufacturer and are stored in the NVRAM 218.

Toner stains on the pressure roller 309 generally increase in proportion to the number of pages of printed matter formed by the printing apparatus 102. Therefore, the CPU 201 stores the number of printed pages in the NVRAM 218, and determines the degree of toner staining on the pressure roller 309 based on the stored number of printed pages to determine whether to execute the second cleaning process or the first cleaning process. The second cleaning process requires an increased number of user operations, but it is more effective in removing toner stains from the pressure roller 309 than the first cleaning process.

Referring again to FIG. 3A, if it is determined in the step S901 that the value of the page counter 1 is not smaller than the first threshold value, the CPU 201 proceeds to a step S907 in FIG. 3B. On the other hand, if the value of the page counter 1 is smaller than the first threshold value, the CPU 201 proceeds to a step S902. The determination in the step S901 is performed so as to carry out cleaning according to the degree of accumulation of toner stains. When the number of pages printed after the immediately preceding execution of the second cleaning process exceeds the first threshold value, which means that the second cleaning process effective in removing toner stains has not been executed for a long time, it is estimated that there is a high possibility of accumulation of toner stains. In such a case, the CPU 201 performs control such that the second cleaning process is executed if possible after execution of the step S907. On the other hand, if the number of pages printed after the immediately preceding execution of the second cleaning process is smaller than the first threshold value, the CPU 201 proceeds to the step S902.

In the step S902, the CPU 201 compares the difference between the value of the page counter 1 and that of the page counter 2 with the second threshold value to thereby determine whether or not the difference between the value of the page counter 1 and that of the page counter 2 is equal to or smaller than the second threshold value. If the difference between them is not larger than the second threshold value, the CPU 201 proceeds to the step S907 in FIG. 3B. On the other hand, if the difference between them is larger than the second threshold value, the CPU 201 proceeds to a step S903. The determination in the step S902 is also performed so as to carry out cleaning according to the degree of accumulation of toner stains. When the number of pages printed after the immediately preceding execution of the first cleaning process exceeds the second threshold value, which means that neither the first cleaning process nor the second cleaning process has been executed for a long time, it is estimated that there is a high possibility of accumulation of toner stains. In such a case, the CPU 201 performs control such that the second cleaning process is executed if possible after execution of the step S907. On the other hand, if the number of pages printed after the immediately preceding execution of the first cleaning process is smaller than the second threshold value, the CPU 201 proceeds to the step S903.

In the step S903, the CPU 201 determines the remaining amount of the K toner. How the remaining amount of the K toner is determined is not described with reference to any figure, but the determination can be performed by detecting the remaining amount of the K toner e.g. by a sensor (detection unit).

If it is determined in the step S903 that the K toner has run out (or the remaining amount of the K toner is insufficient), the CPU 201 proceeds to a step S904. In the step S904, the CPU 201 causes the LCD display section 1001 of the console section 205 to display a message to the effect that the cleaning process (the first cleaning process in the present step) was unsuccessful, as shown in FIG. 5A.

On the other hand, if it determined in the step S903 that the K toner has not run out, the CPU 201 proceeds to a step S905. In the step S905, the CPU 201 issues an instruction for executing the first cleaning process to the printer section 212 via the printer interface 210, and the printer section 212 executes the first cleaning process. The first cleaning process will be described in detail hereinafter. Note that even if the step S902 is omitted, the advantageous effect of the present invention is not impaired. In a case where the step S902 is omitted, if it is determined in the step S901 that the value of the page counter 1 is smaller than the first threshold value, the CPU 201 proceeds to the step S903.

After having issued the instruction for executing the first cleaning process, the CPU 201 stores the value of the page counter 1 as the value of the page counter 2 (step S906), followed by terminating the present process.

Referring to FIG. 3B, in the step S907, the CPU 201 determines the remaining amounts of the respective Y, M, C, and K toners. How the remaining amount of each of the Y, M, C, and K toners is determined is not described with reference to any figure, but the determination can be performed by detecting the remaining amount of each of the Y, M, C, and K toners e.g. by a sensor (detection unit), as mentioned hereinabove.

If it is determined in the step S907 that none of the Y, M, C, and K toners have run out, the CPU 201 proceeds to a step S913. In the step S913, the CPU 201 issues an instruction for executing the second cleaning process to the printer section 212 via the printer interface 210, and the printer section 212 executes the second cleaning process. The second cleaning process will be described in detail hereinafter.

After having issued the instruction for executing the second cleaning process, the CPU 201 resets each of the value of the page counter 1 and that of the page counter 2 to 0 (step S914), followed by terminating the present process.

On the other hand, if it is determined in the step S907 that any one of the Y, M, C, and K toners has run out (or the remaining amount of any one of the Y, M, C, and K toners is insufficient), the CPU 201 determines the remaining amount of the K toner (step S908).

If it determined in the step S908 that the K toner has run out (or the remaining amount of the K toner is insufficient), the CPU 201 proceeds to a step S912. In the step S912, the CPU 201 causes the LCD display section 1001 of the console section 205 to display a message to the effect that the cleaning process (the second cleaning process in the present step) was unsuccessful, as shown in FIG. 5B.

On the other hand, if it determined in the step S908 that the K toner has not run out, the CPU 201 proceeds to a step S909. In the step S909, since the remaining amount of any one of the Y, M, and C toners is insufficient, the CPU 201 causes the LCD display section 1001 of the console section 205 to display a message to the effect that the first cleaning process will be executed in place of the second cleaning process, as shown in FIG. 5C.

Then, the CPU 201 issues an instruction for executing the first cleaning process to the printer section 212 via the printer interface 210, and the printer section 212 executes the first cleaning process (step S910). After having issued the instruction for executing the first cleaning process, the CPU 201 stores the value of the page counter 1 as the value of the page counter 2 (step S911), followed by terminating the present process.

In processing from the step S907 to the step S911, when it is determined that any one of the other toners than the K toner required for the first cleaning process has run out or the remaining amount of the toner is insufficient, the first cleaning process is executed in place of the second cleaning process.

Next, a description will be given of the first cleaning process and the second cleaning process executed in the printing apparatus 102.

Figure 6:
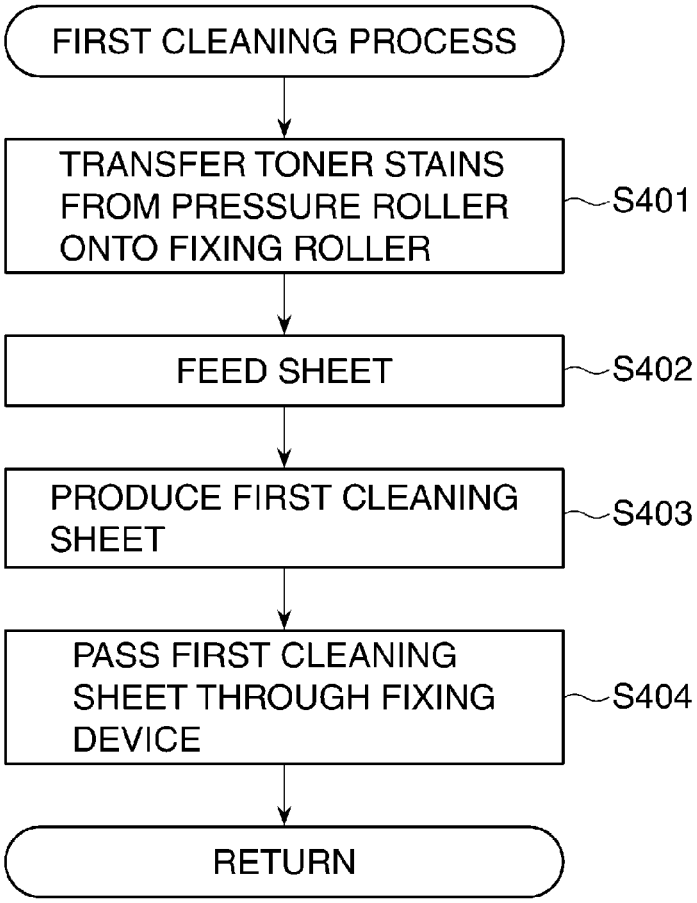
FIG. 6 is a flowchart of a first cleaning process executed by the printing apparatus.

FIG. 6 is a flowchart of the first cleaning process executed by the printing apparatus 102. The first cleaning process described here is executed in the step S905 in FIG. 3A or the step S910 in FIG. 3B. Steps of the first cleaning process shown in the flowchart in FIG. 6 are carried out by the CPU 201 executing an associated program therefor stored in the flash ROM 202.

First, the CPU 201 issues the instruction for executing the first cleaning process to the printer section 212 via the printer interface 210. In the printer section 212, the pressure roller 309 and the fixing roller 308 of the fixing device 306 are rotated to thereby carry out an operation for transferring toner stains from the pressure roller 309 onto the fixing roller 308 (step S401).

Next, a sheet 310 is fed from the sheet feeder 220 to the printer section 212 (step S402).

Figure 8B:
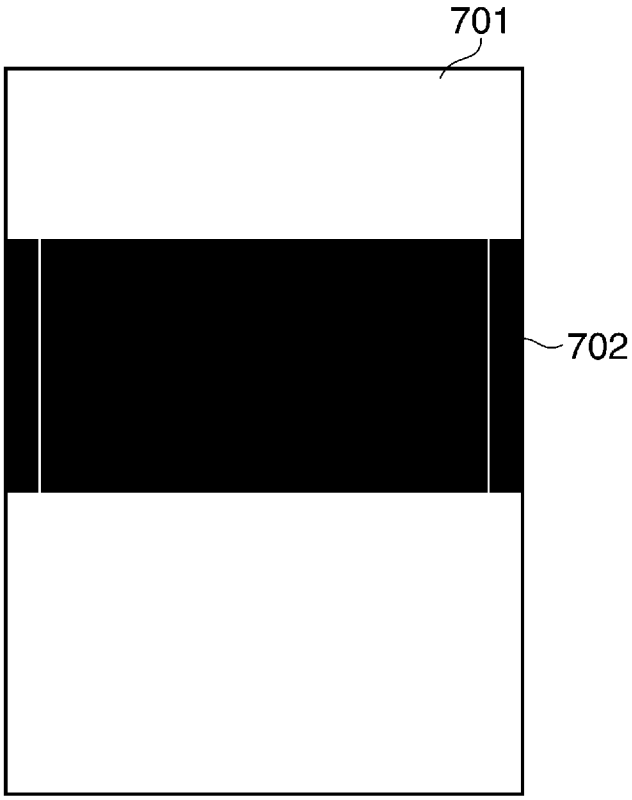
FIG. 8B is a view of an example of a second cleaning sheet for use in the second cleaning process.
Figure 8A:
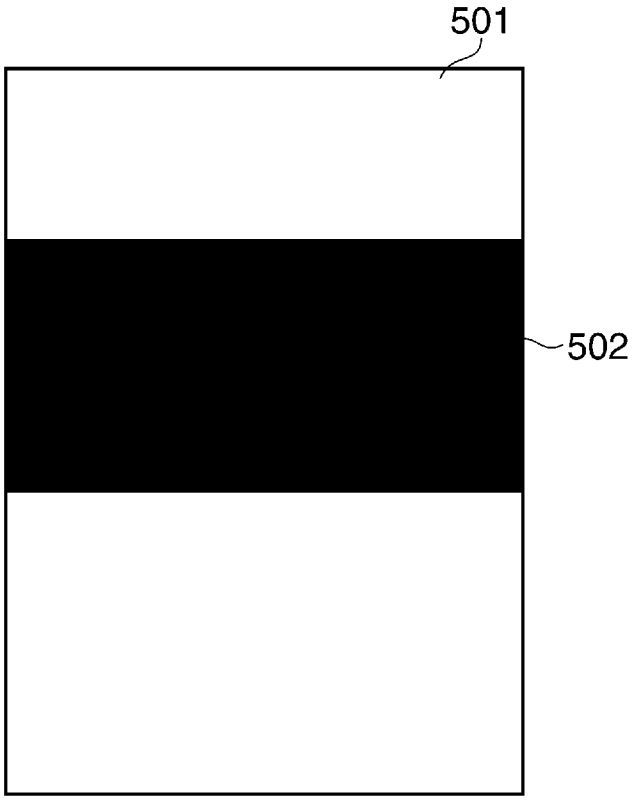
FIG. 8A is a view of an example of a first cleaning sheet for use in the first cleaning process.

Then, the CPU 201 performs control such that the printer section 212 appearing in FIG. 2 transfers a predetermined image onto the first side 311 of the sheet 310 to produce a first cleaning sheet 501 illustrated in FIG. 8A (step S403). The first cleaning sheet 501 (first sheet) has a printed area 502 having a mono-color K toner image transferred thereon. Note that data for printing a predetermined image illustrated in FIG. 8A is stored in advance in the flash ROM 202. In general, a method in which the sheet 310 is printed using all the Y, M, C, and K toners is more effective in removing toner stains from the fixing roller 308, but the method is apt to cause undesired wrapping of the sheet 310 around the fixing roller 308. For this reason, only the K toner is transferred (printed) onto the printed area 502 of the first cleaning sheet 501.

Referring again to FIG. 6, in the step S404, the first cleaning sheet 501 is passed through the fixing device 306. Thus, toner stains are removed from the fixing roller 308 in sliding contact with the first side 311 of the first cleaning sheet 501. Since the toner stains on the pressure roller 309 were already transferred onto the fixing roller 308 in the step S401, removal of the toner stains from the pressure roller 309 is eventually accomplished.

Figure 7:
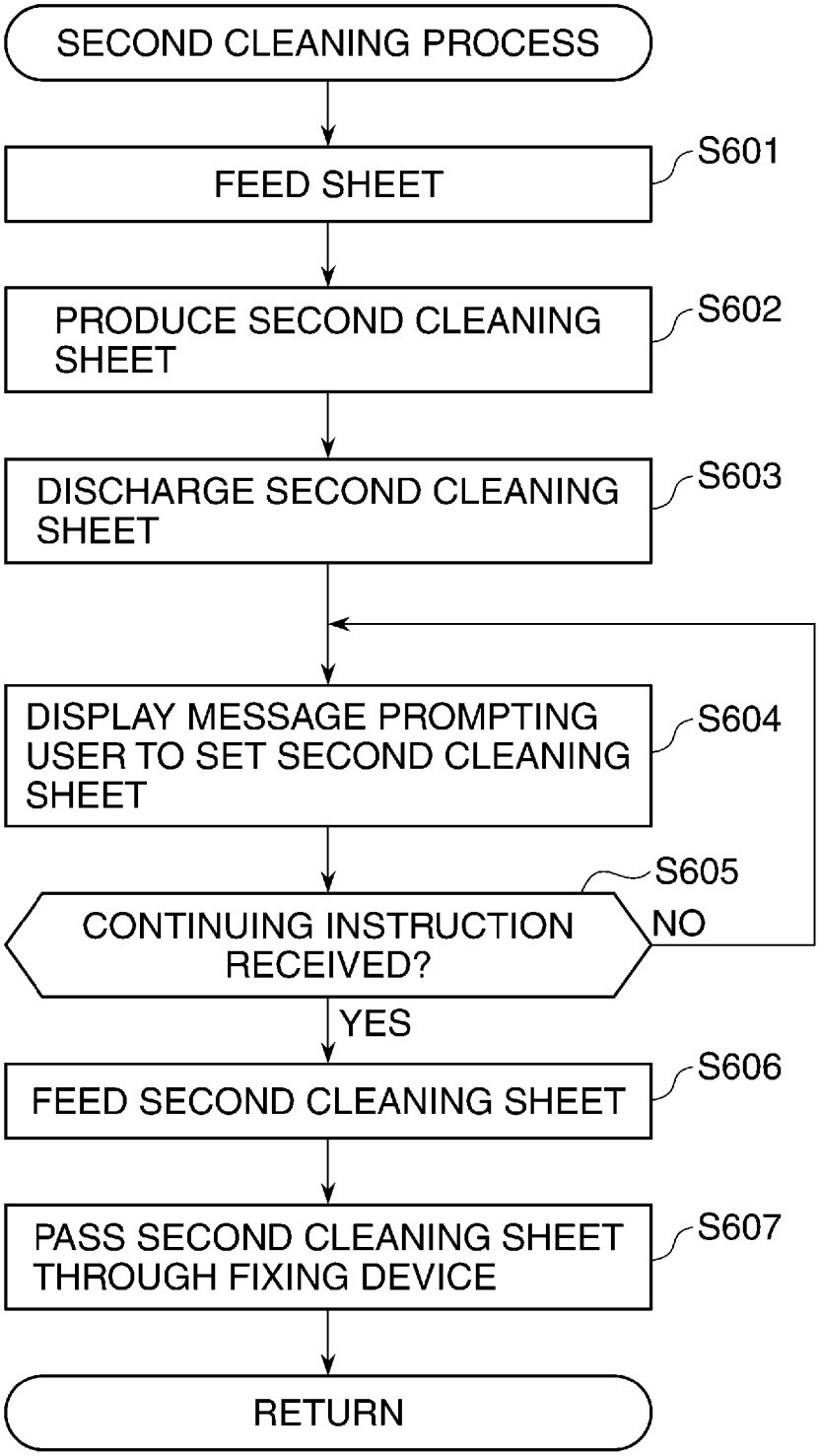
FIG. 7 is a flowchart of a second cleaning process executed by the printing apparatus.

FIG. 7 is a flowchart of the second cleaning process executed in the printing apparatus 102. The second cleaning process described here is executed in the step S913 in FIG. 3B. Steps of the second cleaning process shown in the flowchart in FIG. 7 are carried out by the CPU 201 executing an associated program therefor stored in the flash ROM 202.

First, when the CPU 201 issues the instruction for executing the second cleaning process to the printer section 212 via the printer interface 210, a sheet 310 is fed to the printer section 212 from the sheet feeder 220 (step S601).

Then, the CPU 201 performs control such that the printer section 212 appearing in FIG. 2 causes a predetermined image to be transferred to the first side 311 of the sheet 310 to produce a second cleaning sheet 701 illustrated in FIG. 8B (step S602). The second cleaning sheet 701 (second sheet) has a printed area 702 having a multi-color toner image of Y, M, C, and K colors transferred thereon. Note that data for printing a predetermined image illustrated in FIG. 8B is stored in advance in the flash ROM 202. As mentioned hereinbefore, in the first cleaning process where toner stains transferred from the pressure roller 309 onto the fixing roller 308 are removed from the fixing roller 308, the method of printing the sheet 310 with all of the Y, M, C, and K toners is more effective in the removal of toner stains, but the method is to apt to cause undesired wrapping of the sheet 310 around the fixing roller 308. However, in the second cleaning process, the toner-transferred surface of the second cleaning sheet 701 is brought into contact with the pressure roller 309, and which prevents undesired wrapping of the second cleaning sheet 701 around the fixing roller 308. For this reason, the printed area 702 of the second cleaning sheet 701 have all the Y, M, C, and K toners transferred (printed) thereon.

Referring again to FIG. 7, in a step S603, the second cleaning sheet 701 is passed through the fixing device 306 to fix the image transferred on the first side 311 of the second cleaning sheet 701, and is then discharged from the printing apparatus 102.

Figure 9:
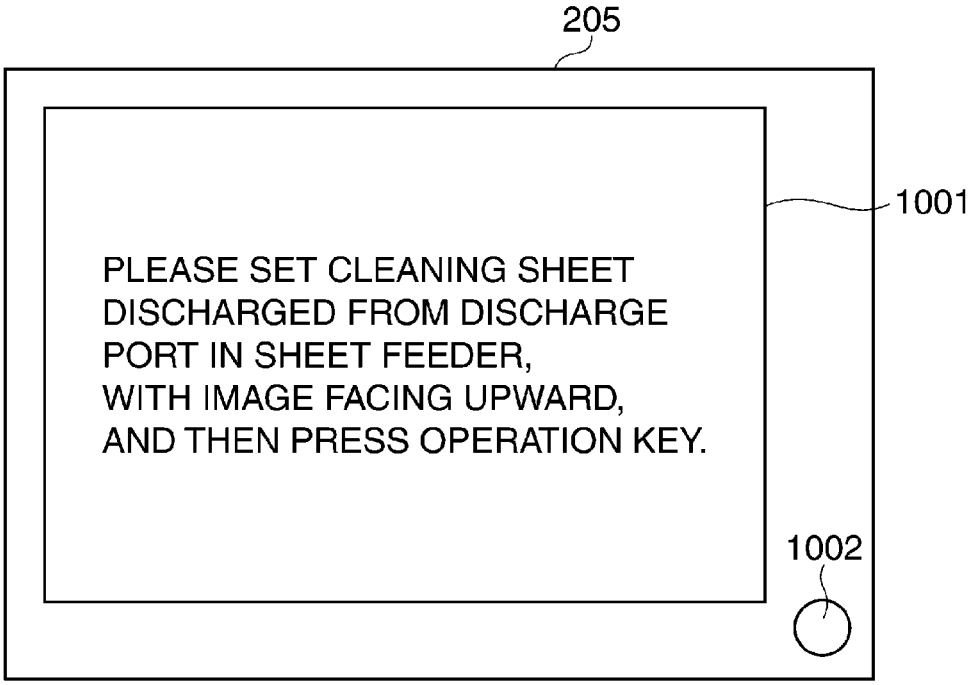
FIG. 9 is a view of an example of display contents displayed on the console section in a step in FIG. 7.

Then, the CPU 201 causes the LCD display section 1001 of the console section 205 to display a message prompting the user to set the discharged second cleaning sheet 701 in the sheet feeder 220, as shown in FIG. 9 (step S604). The user sets the discharged second cleaning sheet 701 in the sheet feeder 220, with the surface of the second cleaning sheet 701 having no image printed thereon facing upward, and presses the operation key 1002 of the console section 205.

Then, the CPU 201 determines whether or not an instruction for continuing the cleaning process (second cleaning process) has been received from the user via the operation key 1002 of the console section 205 (step S605). If the continuation instruction has been received, the CPU 201 proceeds to a step S606.

In the step S606, the CPU 201 causes the second cleaning sheet 701 set in the sheet feeder 220 by the user to be fed from the sheet feeder 220. Since the second cleaning sheet 701 was set with the surface having no image printed thereon facing upward, when it reached the fixing device 306, the opposite surface facing downward of the second cleaning sheet 701, which corresponds to the second side 312 of the sheet 310 shown in FIG. 2, has the image already printed thereon.

Then, the CPU 201 performs control such that the second cleaning sheet 701 passes through the fixing device 306 (step S607). As a consequence, toner stains on the pressure roller 309 in sliding contact with the second side 312 of the second cleaning sheet 701 is removed.

According to the above-described embodiment, even when a user does not determine which cleaning method is to be executed, the printing apparatus is capable of selecting a appropriate cleaning method from a plurality of kinds of applicable cleaning methods and cleaning the pressure roller of the fixing device by the selected cleaning method. For example, when it is estimated that the degree of accumulation of toner stains is high, it is possible to execute the second cleaning process, whereas when it is estimated that the degree of accumulation of toner stains is low, it is possible to execute the first cleaning process.

Further, when the remaining amount of any one of the C, M, and Y toners included in the toners required for execution of the second cleaning process is insufficient, it is possible to execute the first cleaning process using only the K toner instead of executing the second cleaning process.

In the above-described embodiment, which of the first cleaning process and the second cleaning process is to be executed is determined using the page counters 1 and 2 and the first and second threshold values shown in FIG. 4. However, this is not limitative, but the determination may be performed according to the number of pages (or sheets) that have ever been printed since the printing apparatus 102 started to be used after factory shipment. In this case, the page counter is set to 0 and is stored in the NVRAM 218 before the factory shipment, and the CPU 201 increments (counts up) the value of each of the page counters according to the number of pages (or sheets) printed after the factory shipment. The counted-up page count (printed sheet count) is stored (updated) in the NVRAM 218. Then, the CPU 201 refers to the number of printed pages (the number of printed sheets) stored in the NVRAM 218 and performs control such that when the number of pages (sheets) printed after the factory shipment is smaller than a predetermined threshold value, the first cleaning process is executed, and when the number of the printed pages (sheets) is not smaller than the predetermined threshold value, the second cleaning process is executed.

In the above-described embodiment, a one-page image is printed on one sheet, and the printing apparatus 102 determines which cleaning process is to be executed based on the number of printed pages of printed matter. However, the determination may be performed based on the number of printed sheets of printed matter. In this case, even in a case where a plurality of pages are printed on a single page, it is possible to appropriately determine which cleaning process is to be executed.

Note that in the above-described embodiment, when there is no sheet 310 in the sheet feeder 220 in the step S402 or S601, the CPU 201 causes the console section 205 to display a message to the effect that the cleaning process was unsuccessful. A sheet 310 to be fed may be a plain sheet or a special sheet for cleaning.

Although in the above-described embodiment, basically, the method of cleaning the pressure roller is described by way of example, the present invention may be applied to a method of cleaning the heating roller. Further, the image for use in cleaning is not limited to the example shown in FIG. 8A or 8B, but an image pattern different from the examples may be used.

In the above-described embodiment, when it is determined in the step S903 or S908 that the K toner has run out (or the remaining amount of the K toner is insufficient), a message to the effect that the cleaning process was unsuccessful is displayed on the LCD display section 1001 of the console section 205 in the step S904 or S912. However, this is not limitative. For example, the CPU 201 may monitor, using a sensor, whether or not K toner has been replenished, and execute the steps S905 and S906 when K toner has been replenished.

Further, in the above-described embodiment, when it is determined in the step S907 that any one of the Y, M, C, and K toners has run out (or the remaining amount of the toner is insufficient), the steps S908 et seq. are executed. However, this is not limitative, either. For example, when any one of the Y, M, C, and K toners has run out (or the remaining amount of the toner is insufficient), the CPU 201 may monitor, using a sensor, whether or not the toner having run out has been replenished, and execute the steps S913 and S914 when the toner has been replenished.

In addition, the first cleaning process and the second cleaning process are not limited to the examples described in the above-described embodiment, but the second cleaning process is only required to be more effective in removal of toner stains than the first cleaning process. For example, a cleaning sheet may be produced using two or three of the C, M, Y, and K toners for the second cleaning process. Further, the second cleaning process may be performed by setting the cleaning sheet discharged in the step S603 in the sheet feeder 220 a plurality of times to thereby repeatedly carry out the processing from the step S604 to the step S607.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2011-110281 filed May 17, 2011, which is hereby incorporated by reference herein in its entirety.

What is claimed is:

1. A printing apparatus including a fixing device for fixing an image on a sheet, comprising:

a performing unit configured to perform a first cleaning process, in which the fixing device is cleaned using a sheet on which an image is formed with a first number of color of recording material, and configured to perform a second cleaning process, in which the fixing device is cleaned using a sheet on which an image is formed-with a second number of color of recording material, the second number being different from the first number; and a determination unit configured to determine the first cleaning process as a cleaning process to be performed by the performing unit, according to the number of sheets which has been printed.

2. The printing apparatus according to claim 1, wherein the first number of color is one, and wherein the second number of color is more than one.

3. The printing apparatus according to claim 1, further comprising a notification unit configured to notify a user that the first cleaning process is performed, in a case where the determination unit determines the first cleaning process as a cleaning process to be performed by the performing unit.

4. The printing apparatus according to claim 1, wherein the fixing device has a pressure roller and a heating roller, and wherein in the first cleaning process, the pressure roller and the heating roller are rotated, whereby stains on the pressure roller are transferred from the pressure roller to the heating roller, and the stains which have been transferred onto the heating roller are removed.

5. A method of controlling a printing apparatus including a fixing device for fixing an image on a sheet, comprising:

performing a first cleaning process, in which the fixing device is cleaned using a sheet on which an image is formed with a first number of color of recording material;

performing a second cleaning process, in which the fixing device is cleaned using a sheet on which an image is formed with a second number of color of recording material, the second number being different from the first number; and determining the first cleaning process as a cleaning process to be performed, according to the number of sheets which has been printed.

6. A non-transitory computer-readable storage medium storing a computer-executable program for causing a computer to execute a method of controlling a printing apparatus including a fixing device for fixing an image on a sheet, wherein the method comprises:

performing a first cleaning process, in which the fixing device is cleaned using a sheet on which an image is formed with a first number of color of recording material;

performing a second cleaning process, in which the fixing device is cleaned using a sheet on which an image is formed with a second number of color of recording material, the second number being different from the first number; and determining the first cleaning process as a cleaning process to be performed, according to the number of sheets which has been printed.

7. The printing apparatus according to claim 1, further comprising a decision unit configured to decide whether the number of printed sheets reaches a predetermined number, wherein the determination unit determines the first cleaning process as a cleaning process to be performed by the performing unit, based on the decision that the number of printed sheets reaches the predetermined number by the decision unit.

8. The printing apparatus according to claim 1, wherein the second number is more than the first number.

9. The printing apparatus according to claim 1, wherein in the first cleaning process, the fixing device is cleaned using a sheet on which an image is formed-with a first recording material, and wherein in the second cleaning process, the fixing device is cleaned using a sheet on which an image is formed-with the first recording material and a second recording material, the second recording material being different from the first recording material.

10. The printing apparatus according to claim 1, wherein in the second cleaning process, the sheet on which the image is formed is ejected, the sheet which has been ejected and set in a sheet holding unit by a user is conveyed, and the fixing device is cleaned by the conveyed sheet.

11. A printing apparatus including a fixing device for fixing an image on a sheet, comprising:

a performing unit configured to perform a first cleaning process, in which the fixing device is cleaned using a sheet of which one side is faced a first direction, the one side having an image formed thereon, and configured to perform a second cleaning process, in which the fixing device is cleaned using a sheet of which the one side is faced a second direction opposite to the first direction; and a determination unit configured to determine the first cleaning process as a cleaning process to be performed, according to the number of sheets which has been printed.

12. A printing apparatus including a fixing device for fixing an image on a sheet, comprising:

a performing unit configured to perform a cleaning process in which the image is formed on a conveyed sheet and the fixing device is cleaned by the sheet on which the image is formed;

a receiving unit configured to receive an instruction for performing the cleaning process by the performing unit; and a control unit configured to cause the performing unit to perform the cleaning process, in a case where the number of printed sheets reaches a predetermined number and then the instruction is received by the receiving unit.

* * * * *